United States Patent [19]

Greenhut

[11] 3,950,626

[45] Apr. 13, 1976

[54] ROTARY CENTRIFUGALLY-OPERATED ELECTRICAL SWITCH FOR MOTORS

[76] Inventor: Joseph Greenhut, 3333 Warrensville Center Road, Shaker Heights, Ohio 44120

[22] Filed: Sept. 26, 1974

[21] Appl. No.: 509,664

[52] U.S. Cl. ..... 200/80 R; 318/325
[51] Int. Cl.[2] ..... H01H 35/10
[58] Field of Search ..... 200/80 R, 80 A, 80 B; 73/535–551; 340/264; 317/5; 318/325

[56] References Cited

UNITED STATES PATENTS

| | | | |
|---|---|---|---|
| 2,414,470 | 1/1947 | Juhasz | 200/80 R |
| 2,611,602 | 9/1952 | Rosebraugh | 73/550 X |
| 2,616,682 | 11/1952 | Greenhut | 200/80 R |
| 2,768,260 | 10/1956 | Greenhut | 200/80 R |
| 3,793,891 | 2/1974 | Greenhut | 73/538 |

*Primary Examiner*—James R. Scott
*Assistant Examiner*—M. Ginsburg
*Attorney, Agent, or Firm*—Isler & Ornstein

[57] ABSTRACT

A speed-responsive electrical switch assembly consisting of a centrifugally-actuated switch operating unit customarily mounted on a rotatable shaft and having orbitally movable weights engageable with the surface presented by a switch unit to cause make and break operation of the electrical switch contacts. The radial centrifugally-induced inboard and outboard movement of the weights themselves in engagement with the surface of the switch unit, preferably an angularly inclined cam surface, serves to modulate the axial or longitudinal switch-operating, spring-induced displacement of the weights toward or away from the electrical switch unit and thus permits greater latitude in manufacturing and assembly tolerances and with improved switch operating characteristics while still maintaining prior art standards of precision switch control and uniformity of switch action.

19 Claims, 13 Drawing Figures

FIG. 1
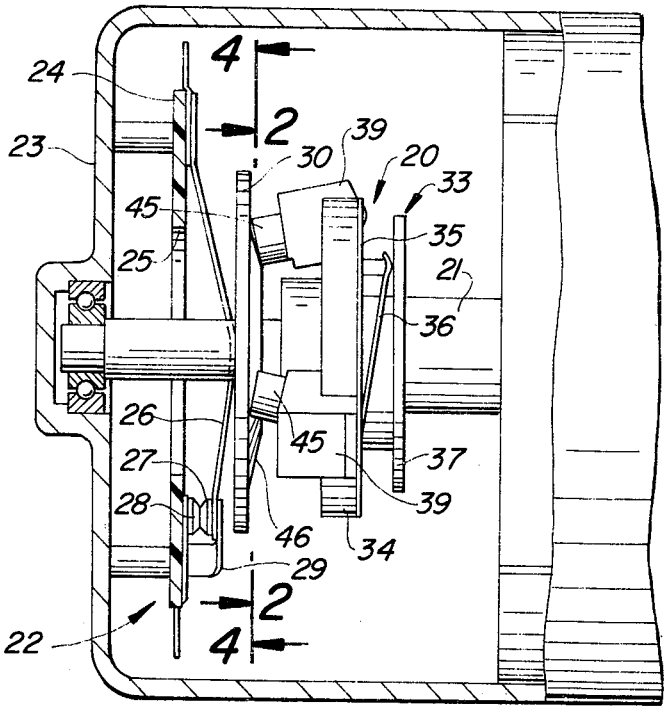
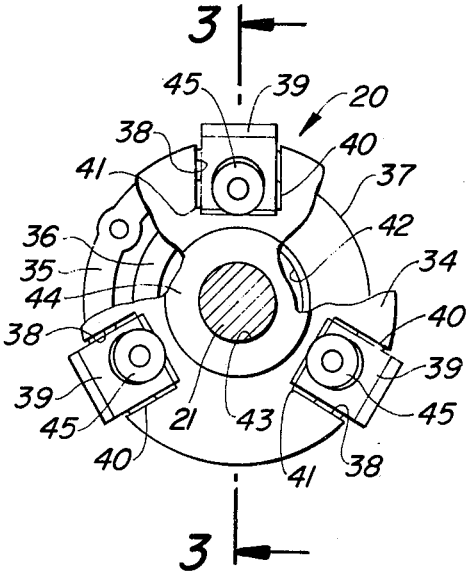
FIG. 2
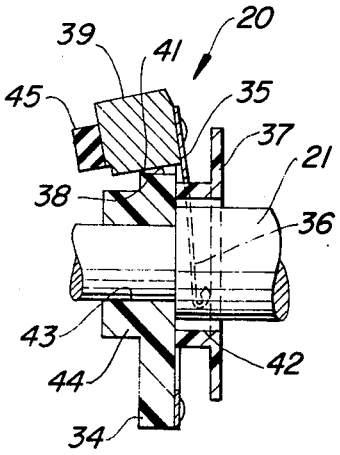
FIG. 3

ROTARY CENTRIFUGALLY-OPERATED ELECTRICAL SWITCH FOR MOTORS

BACKGROUND OF THE INVENTION

The subject matter of the invention relates generally to centrifugally operable speed-responsive devices and more particularly to the operation of an electrical switch unit or stationary switch of the type used for the starting winding circuits of fractional horsepower motors. In my prior U.S. Pat. Nos. 2,616,682; 2,768,260 and 3,793,891 I have provided a detailed and thorough description of the environment in which such devices are utilized and the problems encountered in obtaining uniform operating characteristics and precise operating control. In said U.S. Pat. No. 2,768,260, I have discussed the various factors involving cumulative assembly and manufacturing tolerances which could significantly affect the operating characteristics of such a speed-responsive switching device. Reference is made to the foregoing patents for a fuller discussion of such devices.

It may be noted that the centrifugally-actuated switching devices referred to in the foregoing prior patents, all utilize orbiting weights to flex a snap-action spring to which a switch-engaging spool is secured. Normally the spring projects the spool against the resilient contact arm of the stationary switch to maintain the starting winding circuit of the motor closed when the motor is in the static or non-running condition. After the motor is energized and attains a sufficiently high speed to no longer require the starting torque advantages of the starting winding circuit, the orbiting masses or weights cause snap action of the spring to retract the spool from the stationary switch and open the circuit to the starting winding. The spool moves longitudinally or axially toward and away from the contact arm of the stationary switch in response to the action of the spring. When the motor is deenergized or if for any other reason its speed is drastically reduced, the orbiting weights lose energy and the force of the spring is eventually sufficient to overcome the action of the weights and snap back the spool to its switch-engaging static position. The switch-actuating spool moves contemporaneously and directly with the longitudinal movement of the spring, so that the entire action of the spool is one of longitudinally directed movement over the range of longitudinal displacement accomplished by the spring. The centrifugally-induced movement of the weights which cause deflection of the spring have an indirect effect through the spool on the operation of the stationary switch; but there is no direct engagement of the weights with the stationary switch.

As discussed in the prior art patents, particularly U.S. Pat. No. 2,768,260, the spacing between the stationary switch and the centrifugal device is critical in obtaining the desired speed-responsive characteristics and this spacing does vary due to cumulation of manufacturing tolerances and assembly tolerances in commercial production.

Another problem can be characterized as "contact bounce" and "flutter" both of which can and do occur when assembly tolerances cumulate to the point where a positive closing action of the stationary switch is not uniformly attainable. Inasmuch as the reaction force of the stationary switch contact arms does have an effect on the cut-out and cut-in speeds of the centrifugal unit, any flutter or contact bounce necessarily produces non-uniformity in the operating speeds of the centrifugal unit and in its snap-action characteristics.

SUMMARY OF THE INVENTION

It is a primary object of the invention to provide a switch assembly of the character described which will utilize the weights themselves as the switch-engaging devices, rather than using a spring-mounted spool or other spring-projected piece.

Another object of the invention is to provide such an assembly in which the movement of the weights radially is used in cooperation with the spring-induced longitudinal displacement of the weights to modulate the effect of the longitudinal displacement and thus permit the attainment of uniform operating characteristics of the assembly over a broader range of manufacturing and assembly tolerances than has heretofore been accomplished.

Still another object of the invention is to utilize a camming surface on the stationary switch which is engageable by the radially moving weights to reduce contact bounce and flutter and to provide a greater extent of over-travel to further increase the possible range of manufacturing and assembly tolerances within which precise snap action of the spring and uniformity of control can be attained.

A further object of the invention is to provide a rotary device of the type described which consists of fewer components and is less costly to manufacture than the prior art devices intended for similar purposes.

Other objects and advantages of the invention will become apparent during the course of the following description.

BRIEF DESCRIPTION OF THE DRAWING

In the drawings, in which like reference numerals designate like parts throughout the same, FIG. 1 is a view in side elevation showing the relative positions of the stationary switch and the rotary device before cutout speed of the rotary unit has been attained and the weights have been retracted by the spring from engagement with the stationary switch.

FIG. 2 is a cross-sectional view, taken as indicated on line 2—2 of FIG. 1 and showing a plan view of the rotary unit, with portions thereof being broken away to show detail.

FIG. 3 is a sectional view, taken as indicated on line 3—3 of FIG. 2.

DESCRIPTION OF THE PREFERRED EMBODIMENTS

Figure 4:
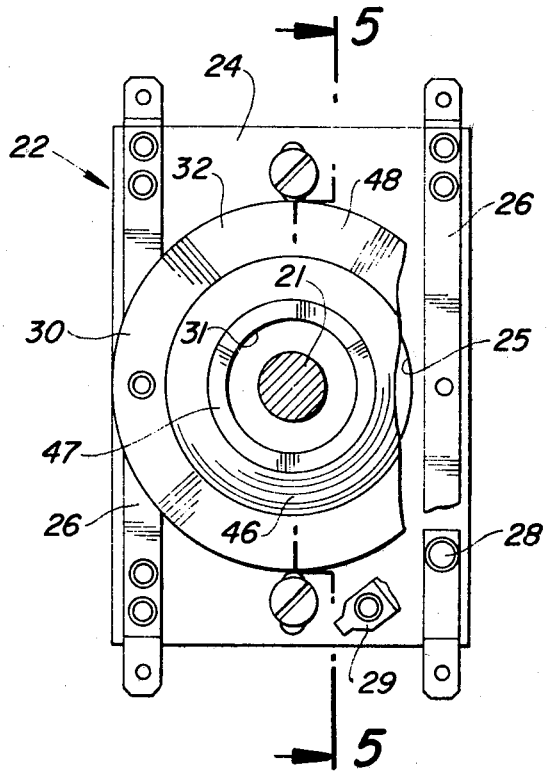
FIG. 4 is a sectional view similar to FIG. 2, taken as indicated on line 4—4 of FIG. 1 and showing a plan view of the stationary switch, with portions thereof broken away to show detail.
Figure 5:
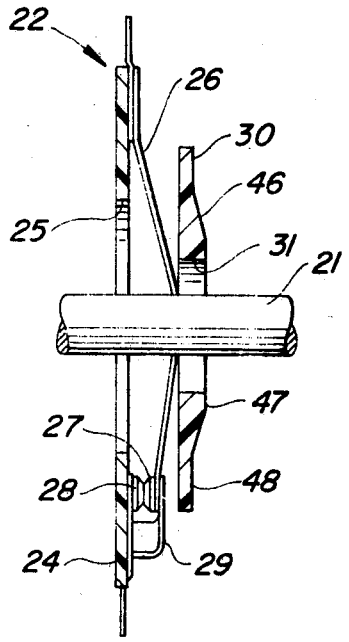
FIG. 5 is a sectional view, taken as indicated on line 5—5 of FIG. 4.

Referring to FIGS. 1 through 10 of the drawings, and more particularly to FIGS. 1–5 thereof, there is shown a centrifugally-actuated switch-operating unit 20 which will at times be hereinafter referred to as the "rotary" or "centrifugal unit". The rotary can be mounted for rotation on any rotating member or element 21 of the device to be controlled. As herein illustrated, the element 21 is represented by the shaft of an electrical motor.

Fixedly mounted in axially spaced relationship to the rotary is a stationary electrical switch unit 22 which may be affixed to the frame or end bell or other suitable fixed portion 23 of the device or motor. By way of example, the stationary unit 22 is an electrical switch forming a circuit component of the starting winding circuit of an electrical motor. The stationary switch unit includes a base plate 24 of insulating material which is suitably apertured as at 25 to permit traversal thereof by the shaft 21. Suitably secured to the base plate are a pair of electrically conductive resilient spring arms 26, one or both of which can be provided with an electrical contact 27 for engagement with an electrical contact 28 which is provided on the base plate 24. The resilient characteristics of the spring arms normally maintain the contacts 27 and 28 in spaced or open relationship, the upper limit of movement of the spring arms being limited by a suitable stop or abutment 29 which overlies the free end of the spring arm. It will be understood that the described normally open position of the contacts is simply by way of example and that the stationary switch could be provided with normally closed contacts if the particular control circuit required such a design.

The spring arms 26 have been shown mounted in a cantilever arrangement with a contact 27 provided on only one of the arms. The other of the arms 27 does not function as a contact arm, but merely serves as a resilient equalizing support for a switch plate 30 which is secured across the spaced spring arms 26 intermediate the ends thereof. The switch plate 30 is provided with a central opening 31 to permit traversal thereof by the shaft 21. Surrounding the central aperture 31, the switch plate presents a surface 32 which, as will appear more fully hereinafter, is engageable by the weights of the rotary unit to operate the switch and establish make or break of the starting winding circuit of the motor.

The rotary unit 20 includes a body 33 consisting of a stabilizer element or plate 34 for a disc-shaped conical snap-action spring 35 having a plurality of upwardly projecting integral resilient fingers 36 which react against and are suitably anchored to a spring support plate 37 which is affixed to the stabilizer plate 34 in spaced relationship thereto. The characteristics and advantages of utilizing this type of spring 35 are more fully discussed and disclosed in my U.S. Pat. Nos. 2,616,682 and 2,768,260.

The stabilizer plate 34 is provided with a plurality of peripheral notches 38 which correspond in number to the number of weights utilized in the rotary unit 20, this quantity being here illustrated as three. A plurality of weights 39 are affixed to the periphery of the spring 35 in uniform circumferentially spaced relationship and extend within the notches 38 so as to be free to move radially outwardly in response to centrifugal forces, but are restricted by the radially-extending edges or walls 40 of the notch against torsional or twisting movement. The chordal edge 41 of the notch may be so located as to also limit the inward radial movement of the weights 39 to their static position or position of rest. In certain applications, such an abutment or stop 41 is desirable as it permits the rotary to be designed with a predetermined degree of pre-stress on the spring 35 when the rotary is in the static position and thereby permits more accurate control of operating characteristics of the rotary when extreme precision is required. In other instances, where such a high degree of precision is not necessary, the edge 41 can be positioned on the stabilizer plate so as not to interfere with or restrict the inboard movement of the weights to their static position.

The spring support plate 37 is provided with a central clearance opening 42 to permit the shaft 21 to extend therethrough. The stabilizer plate 34 is also provided with a central aperture 43 which is sized for the diameter of the shaft 21 so that the rotary unit 20 can be secured for coaxial rotation with the shaft by a press fit securement or by other suitable securement. Preferably the mounting aperture 43 extends through a collar 44 or other reasonably thick cross-section of the plate 34 to provide a bearing or guide surface of suitable length in the plate 34 for purposes of mounting it on the shaft. It will be understood that the spacing between the rotary unit 20 and the stationary switch unit 22 is carefully controlled and predetermined to attain the desired operating characteristics of the switch assembly.

The weights 39 may be of any suitable form and are herein illustrated as being of a generally cubical configuration. It is desirable, although not mandatory, that the bottom portion of the weights which will engage the switch plate 30 be provided with some suitable projections or glides which are here shown as plastic wear pads 45.

In general, the operation of the switch assembly is related to a preselected rotational speed of the shaft 21 and the design characteristics of the device are related to such factors as the size and strength of the spring arms 36, the mass of the weights 39, the extent, if any, to which the spring 35 is pre-stressed, the spacing between the rotary unit 20 and the stationary switch 22, the strength and degree of resiliency of the spring arms 26, the range of movement of the contacts 27 from open to closed position and the unavoidable variables which affect these factors and result from manufacturing and assembly tolerances. It will be noted that the majority of these factors affect or influence the longitudinal or spacing relationship between the rotary and stationary units. In the prior art devices, as exemplified by the previously mentioned U.S. patents, a shoe or spool was utilized on the rotary unit to advance toward or withdraw from the stationary switch in response to speed-regulated snap action of the spring of the rotary.

The path of movement of the shoe or spool was wholly axial or longitudinal, whereas in the present disclosed embodiments the weights 39 contact the stationary switch directly, without the intermediary of a spool or shoe, and, as the weights have both longitudinal spring-actuated displacement or motion as well as centrifugally-actuated radial displacement or motion, this latter motion can be utilized to compensate for and offset changes in operating conditions of the switch assembly which may result from these factors which affect the longitudinal relationship between the parts. In short, the radial movement of the weights 39 provides a switch-operating function or force which is substantially independent of the commercial variations which may occur with respect to the designed longitudinal relationships of the components of the switch assembly. The switch plate 30 provides a means for maintaining continuity of engagement between the spring arms 26 of the stationary switch and the discrete switch-engaging elements represented by the individual weights 39.

Although the advantages obtained from utilization of the radial motion of the weights for switch operation can be achieved by utilizing a planar or flat surface on the switch plate 30, these advantages can be augmented and enlarged by utilizing an angularly inclined or beveled surface 46 on the switch plate; the angle of inclination being such as to converge toward the axis of the shaft 21 in a direction toward the rotary 20 and provide a cam surace.

Figure 6:
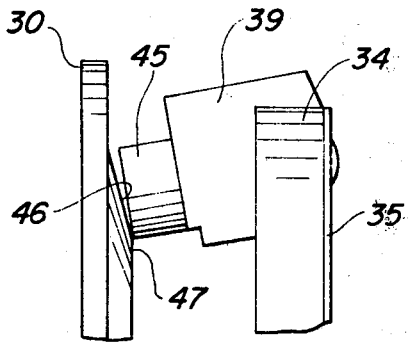
FIG. 6 is an enlarged sectional view showing the position of a representative weight on the switch plate when the rotary unit is in a static position.

Referring more particularly to FIGS. 6 through 10 of the drawings, various positions of the parts in the sequence of operation of the switch assembly are illustrated. FIG. 6 illustrates the position of a weight 39 when the rotary unit 20 is in its static or non-running position. It will be noted that the projection 45 of the weight 39 has come to rest close to the inner edge of the beveled surface 46, either on the beveled surface itself or on a narrow planar inward extension surface 47 which surrounds the aperture 31. In this position of the weights, the switch plate 30 is displaced longitudinally to bear down on the spring arms 26 and maintain the contacts 27 and 28 in closed circuit-making position. The previously mentioned chordal edge 41 of the notch 38 can also serve as a limiting abutment for the innermost position of the weight 39 to establish uniformity and consistency for the static position of the weight on the switch plate surface as well as to arrest any tendency of the spring arms 26, acting through the switch plate, to displace the weights radially further beyond their normal inboard over-center posture.

When the motor is energized or the shaft 21 is actuated for rotation, orbital movement is imparted to the weights 39 by the contemporaneous rotation of the rotary unit 20 with the shaft 21. As the rotational speed of start-up increases, the centrifugal forces acting on the weights 39 cause a radial outbard movement of the weights toward and through the over-center position. This outboard radial movement of the weight acting on the periphery of the conical disc spring 35 causes some initial deflection and energization of the spring 35 which is translated into a relatively small extent of spring-induced retraction or withdrawal of the weights in an axial or longitudinal direction.

Figure 7:
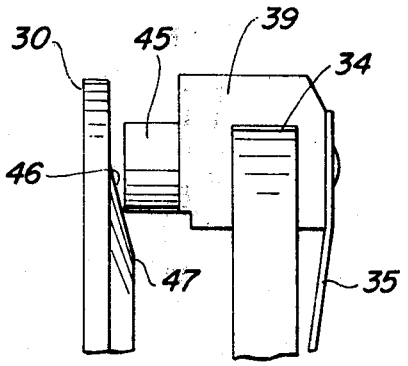
FIG. 7 is a view similar to FIG. 6 showing the position of the representative weight during the initial start up of the rotary unit.

It will be understood that it is intended that the high-torque starting winding circuit established through the contacts 27–28 be maintained until the motor has closely approached or attained its operative running speed, at which point the starting winding circuit can be opened as the starting winding is no longer needed. Heretofore, the initial slight longitudinal retraction of the spool during start-up, particularly where manufacturing and assembly tolerances had cumulated to significantly affect the longitudinal spacing between the rotary and the stationary units, resulted in contact flutter in the stationary switch during the low rotational start-up speed with consequent sparking and erratic and unnecessary rapid and repetitive making and breaking of the starting winding circuit until the fully open position of the contacts was achieved. FIG. 7 of the drawings illustrates the position of the weight 39 as it has traveled outwardly along the beveled surface 46 to about an on-center posture which is substantially parallel to the axis of rotation. This radial outward movement of the weight occurs simultaneously with or just slightly ahead of the previously described initial longitudinal withdrawal of the weights effected by the spring 35. The change in effective length of the weight with respect to the opposed switch plate 30 during this initial radial movement of the weight from an inboard angular position to a center position is equal to or greater than the slight extent of longitudinal withdrawal of the weights effected by the spring 35, so that this initial longitudinal retraction with respect to the stationary switch is modulated and offset by at least a compensating longitudinal advance of the weights toward the switch plate through their radial movement. Thereby, the contacts 27–28 are maintained locked in closed position and the previously described tendency for contact flutter is eliminated.

Figure 8:
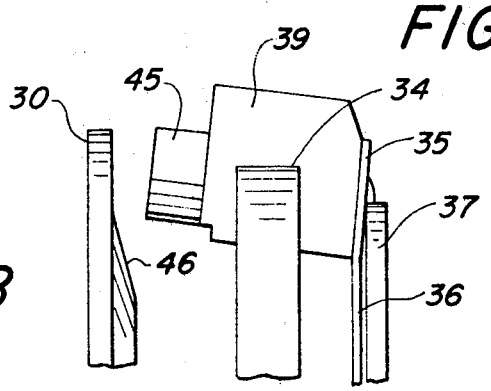
FIG. 8 is a view similar to FIG. 6 showing the retracted position of the weight when the rotary unit has attained its cut-out speed.

FIG. 8 illustrates the position of the parts when the switch cut-out speed has been attained and the centrifugal force acting on the weights has caused them to swing radially outboard through the center position and deflect the spring 35 to cause snap-action of the spring for longitudinal withdrawal of the weights from engagement with the switch plate. Upon such disengagement, the resilient character of the spring arms 26 rapidly assume their normally open position breaking the circuit to the starting winding. As long as a reasonable range of running speed is maintained, the weights will remain withdrawn as indicated in FIG. 8.

Figure 9:
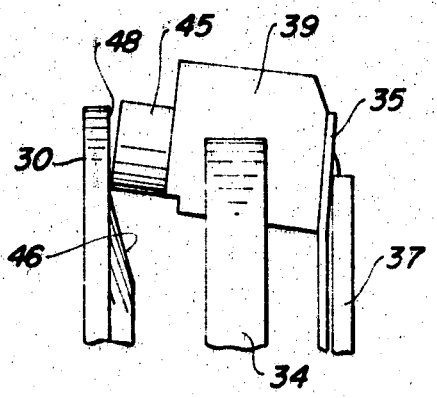
FIG. 9 is a view similar to FIG. 6 showing the position of the representative weight with respect to the stationary switch when the motor or other rotary device has been deenergized and its rate of speed is rapidly reducing.
Figure 10:
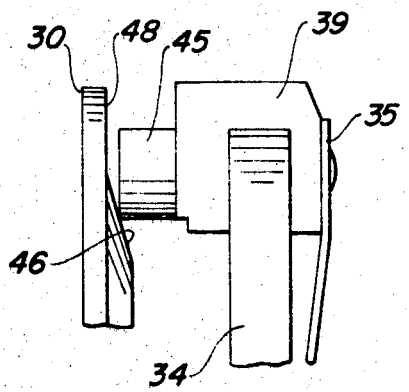
FIG. 10 is a view similar to FIG. 6 showing the movement of the weight of FIG. 9 onto the camming surface of the switch plate during the further reduction of speed of the rotary device.

When the motor or other device is deenergized, the rotational speed of the shaft 21 gradually diminishes with a consequent lessening of the centrigual force acting on the weights 39. As the speed lessens and the weights move slowly radially inwardly, the spring 35 causes longitudinal advance of the weights into reengagement with the surface of the switch plate 30, as illustrated in FIG. 9 of the drawings. A planar outer extension surface 48 of the beveled surface 46 may be provided on the switch plate as a convenient lead-in surface to the surface 46. As shown in FIG. 9, the weight 39 has engaged the surface 48 and has just started its radial movement inwardly at the outer edge of the camming surface 46. The weights are still in a substantial outboard over-center posture and there has been no operative longitudinal displacement of the switch plate 30.

Further gradual reduction in the speed of rotation of the deenergized device results in further radially inward movement of the weights 39 onto the beveled surface 46, but the extent of such inward movement of the weights is still not sufficient to trigger snap-action of the spring for full longitudinal advance of the weights against the switch plate. The parts are in the position shown in FIG. 10 with the contacts still in the open position.

As the speed approaches the cut-in point of the starting winding circuit, the weights move further radially inwardly over-center camming the contacts closed while simultaneously the snap action of the spring 35 provides the final abrupt longitudinal advance of the weights against the switch plate. The position of the parts is then as previously described and illustrated with reference to FIG. 6 for the non-running or static position. Thus, both the longitudinal thrust of the weights effected by the snap action of the spring 35 and the camming action resulting from radially inward movement of the weights on the bevel surface 46 cooperate to effect rapid closing of the contacts and lock the contacts in their closed position without permitting contact bounce or flutter. The beveled camming surface also permits a greater range of over-travel of the weights in a longitudinal direction without significantly varying the predetermined cut-in and cut-out switch operating speeds.

Figure 11:
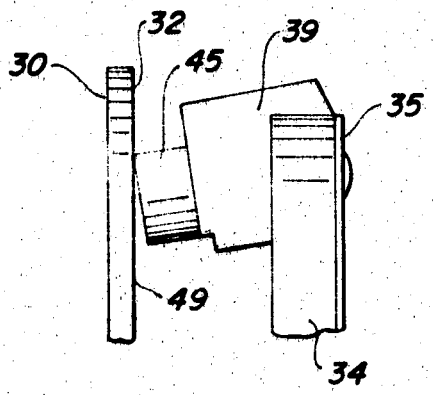
FIG. 11 is a fragmentary view similar to FIG. 6, but showing a modified form of switch plate on the stationary switch.

The utilization of the radial movement of the weights and their direct engagement with the stationary switch to modulate the spring-induced longitudinal displacement of the switch-engaging weights and compensate for large tolerance variations in manufacturing and assembly, results in providing greater uniformity of switch action over a much broader tolerance range, as well as greater precision and uniformity in the snap action of the spring 35 and less contact bounce and flutter in the stationary switch. These advantages are attained even if the switch plate 30 is provided with a planar surface 49, as illustrated in FIG. 11 of the drawings, without utilization of a beveled surface portion 46. The beveled surface 46 enhances or augments the previously described advantages by enlarging or widening the permissable tolerance range and the permissable extent of overrun which can be accomodated without significantly affecting the desired speed operating characteristics of the stationary and rotary units.

Figure 12:
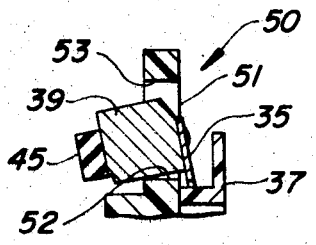
FIG. 12 is a fragmentary sectional view similar to FIG. 3, but showing a modified form of the rotary centrifugal unit.

FIG. 12 shows a fragmentary view of a modified form of rotary unit 50 which is the same as the previously described rotary unit 20 except that instead of utilizing peripheral notches 38 on the stabilizer plate 34, a modified stabilizer plate 51 is utilized having circumferentially spaced apertures or openings 52 as a restraint upon the movement of the weights 39. The apertures 52 function in the same manner as the previously described notches 38 to prevent torsional or twisting displacement of the weights resulting from rotational forces, as well as to limit inward radial movement of the weights. Additionally, the openings 52 also are provided with an edge or wall 53 which limits radially outward movement of the weights 39 and thus prevents undue stress or fatigue on the securement between the weights and the spring 35 as well as on the spring itself at high running speeds.

Figure 13:
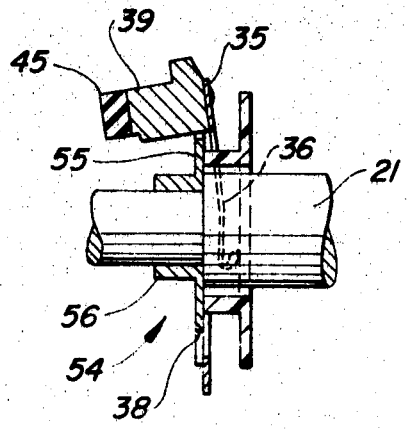
FIG. 13 is a sectional view similar to FIG. 3 showing another modification of the rotary centrifugal unit.

FIG. 13 is a view similar to FIG. 3 but showing another modified form of rotary unit 54 which utilizes a lightweight, inexpensive metal stamping 55 provided with an extruded collar 56 to serve as the stabilizer plate. This stabilizer plate may be provided with notches 38 as was the previously described stabilizer plate 34. The collar 56 of stabilizer plate 55 is sized for a press fit securement onto shaft 21.

Thus, the advantages of the invention can be attained by using a plane surface on the switch plate or these advantages can be enhanced by utilizing a beveled camming surface; restraining abutments may be utilized to minimize fatigue resulting from torsional or twisting displacement of the weights as well as to limit radial movement of the weights either inwardly or outwardly or in both directions; and stabilizer plates may be formed of materials of thin section or of thick section as desired. By utilizing a floating spring and weight assembly, with the weights having direct physical engagement with the stationary switch, a shaft-mounting element can be used which also serves as a stabilizer plate for the conical disc spring and thereby reduces the number of parts in the centrifugal switch assembly as well as permitting it to be more compact and of smaller size, without any sacrifice of its inherent functional objectives, but with improved performance characteristics and uniformity of operation resulting from utilization of the radial movement of the weights acting in concert with the spring-induced longitudinal displacement of the weights directly on the stationary switch.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

Having thus described my invention, I claim:

1. In a rotary speed-responsive electrical switch assembly, the combination of a centrifugal switch-operating unit adapted to be mounted for rotary movement, a switch unit adapted for mounting in spaced relationship to said centrifugal unit, spring means carried by said centrifugal unit, centrifugally actuated weights operatively attached to said spring means for radial displacement to effect energizing deflection of said spring means in response to a predetermined rotational speed thereof, said weights being bodily displaced axially by said spring means to advance and retract said weights into and out of engagement with said switch unit in response to rotational speed changes, and a surface provided in association with the electrical contacts of said switch unit and directly engageable by said weights and responsive to the longitudinal and radial movements thereof for operating said switch unit.

2. In a rotary speed-responsive electrical switch assembly, the combination of a centrifugal switch-operating unit adapted to be mounted for rotary movement, a switch unit adapted for mounting in axially-spaced relationship to said centrifugal unit, spring means carried by said centrifugal unit, centrifugally displaceable weights operatively attached to said spring means to effect energizing longitudinal switch-operating displacement of said spring means by radial movement of said weights in response to a predetermined rotational speed thereof, said weights being bodily displaced axially by said spring means to advance and retract said weights into and out of engagement with said switch unit in response to rotational speed changes, and a surface provided on said switch unit in the path of radial movement of said weights and engageable thereby to modulate the switch-operating action resulting from longitudinal displacement of said spring means toward and away from said switch unit.

3. A combination as defined in claim 2, wherein said spring means is a snap-action spring.

4. A combination as defined in claim 2, wherein said spring means yieldably maintains said weights in engagement with said switch unit.

5. A combination as defined in claim 2, wherein said centrifugal unit is provided with a spring-stabilizer plate for mounting on a rotatable shaft.

6. A combination as defined in claim 5, wherein said stabilizer plate is provided with circumferentially-spaced passageways traversed by said weights, whereby to limit movement of said weights.

7. A combination as defined in claim 6, wherein said passageways limit torque-induced displacement of said weights.

8. A combination as defined in claim 6, wherein said passageways limit radial displacement of said weights.

9. A combination as defined in claim 2, wherein said switch unit is provided with a yieldably movable contact element, and with a switch plate operably engageable with said contact element and presenting said surface thereon.

10. A combination as defined in claim 9, wherein said surface is a cam surface.

11. A combination as defined in claim 10, wherein said cam surface is annular and is angularly inclined to the axis of rotation of said centrifugal unit.

12. A combination as defined in claim 11, wherein said cam surface has a slope convergent toward said centrifugal unit.

13. A combination as defined in claim 2, wherein radial movement of said weights is pivotal between and over-center inboard position and an over-center outboard position of said weights.

14. A combination as defined in claim 12, wherein said weights move along said cam surface in response to rotary motion of said switch-operating unit.

15. A combination as defined in claim 13, wherein said weights move radially inboard on said surface when rotary motion of said switch-operating unit advances said weights longitudinally toward said switch unit.

16. A combination as defined in claim 13, wherein said weights move radially outboard on said surface when rotary motion of said switch-operating unit displaces said weights longitudinally away from said switch unit.

17. A combination as defined in claim 13, wherein said pivotal movement of said weights along said surface acts upon said switch unit in cooperation with and modification of the spring-induced longitudinal movement of said weights.

18. A combination as defined in claim 13, wherein said surface is a cam surface angularly inclined to the axis of rotation of said centrifugal unit.

19. A combination as defined in claim 17, wherein initial radial outboard movement of said weights on said surface has an effective longitudinal displacement effect toward said switch unit of greater magnitude than the oppositely directed longitudinal withdrawal of said weights initially effected by said spring means.

* * * * *